US009000346B2

(12) United States Patent
Dinc et al.

(10) Patent No.: US 9,000,346 B2
(45) Date of Patent: Apr. 7, 2015

(54) ILLUMINATION UNIT

(75) Inventors: Mustafa Dinc, Heilbronn (DE); Harald Lunt, Sinsheim-Reihen (DE); Franz X. Rettenmeier, Kirchheim/Neckar (DE); Jörg Angerstein, Flein (DE)

(73) Assignee: Vishay Electronic GmbH, Selb (DE)

( * ) Notice: Subject to any disclaimer, the term of this patent is extended or adjusted under 35 U.S.C. 154(b) by 885 days.

(21) Appl. No.: 13/146,411

(22) PCT Filed: Jan. 27, 2010

(86) PCT No.: PCT/EP2010/000488

§ 371 (c)(1),
(2), (4) Date: Oct. 6, 2011

(87) PCT Pub. No.: WO2010/086150

PCT Pub. Date: Aug. 5, 2010

(65) Prior Publication Data

US 2012/0018623 A1 Jan. 26, 2012

(30) Foreign Application Priority Data

Jan. 27, 2009 (DE) ..... 10 2009 006 184

(51) Int. Cl.

| | |
|---|---|
| ***F21V 7/00*** | (2006.01) |
| ***F21K 99/00*** | (2010.01) |
| *F21V 17/12* | (2006.01) |
| *F21V 23/04* | (2006.01) |
| *F21V 29/00* | (2006.01) |

(Continued)

(52) U.S. Cl.

CPC . *F21K 9/00* (2013.01); *F21V 17/12* (2013.01); *F21V 23/0435* (2013.01); *F21V 23/0442* (2013.01); *F21V 29/004* (2013.01); *F21W 2131/103* (2013.01); *F21Y 2101/02* (2013.01); *F21Y 2105/00* (2013.01); *F21Y 2103/003* (2013.01); *F21Y 2105/001* (2013.01); *F21V 29/505* (2015.01); *F21V 29/74* (2015.01)

(58) Field of Classification Search

CPC ..... G01J 1/4204
USPC ..... 250/214 AL; 136/250–251; 257/91–93
See application file for complete search history.

(56) References Cited

U.S. PATENT DOCUMENTS

| | | | |
|---|---|---|---|
| 4,847,734 | A | 7/1989 | Katoh et al. |
| 6,318,886 | B1 | 11/2001 | Stopa et al. |

(Continued)

FOREIGN PATENT DOCUMENTS

| | | | |
|---|---|---|---|
| DE | 29 41 634 | A1 | 4/1980 |
| DE | 3148843 | A1 | 6/1983 |

(Continued)

OTHER PUBLICATIONS

German Search Report dated Oct. 1, 2009. DE 10 2009 006 184.3.

(Continued)

*Primary Examiner* — Seung C Sohn

(74) *Attorney, Agent, or Firm* — Gifford, Krass, Sprinkle, Anderson & Citkowski, P.C.

(57) ABSTRACT

An illumination unit for illuminating large surfaces comprises a carrier device (11), to which a plurality of light emitting diodes (13) is fastened in a two-dimensional arrangement. A plurality of separate reflector elements (17) is fastened to the carrier device between the light emitting diodes.

33 Claims, 4 Drawing Sheets

(51) Int. Cl.

| | |
|---|---|
| *F21W 131/103* | (2006.01) |
| *F21Y 101/02* | (2006.01) |
| *F21Y 105/00* | (2006.01) |
| *F21Y 103/00* | (2006.01) |

(56) References Cited

U.S. PATENT DOCUMENTS

| | | | | |
|---|---|---|---|---|
| 6,367,949 | B1 | 4/2002 | Pederson | |
| 6,871,982 | B2 | 3/2005 | Holman et al. | |
| 7,766,510 | B2 | 8/2010 | Lee | |
| 7,947,894 | B2 * | 5/2011 | Nakata | 136/250 |
| 2004/0264187 | A1 | 12/2004 | Vanderschuit | |
| 2005/0116235 | A1 | 6/2005 | Schultz et al. | |
| 2005/0122018 | A1 | 6/2005 | Morris | |
| 2006/0146531 | A1 | 7/2006 | Reo et al. | |
| 2007/0189001 | A1 | 8/2007 | Nielson et al. | |
| 2008/0158879 | A1 | 7/2008 | Sun et al. | |
| 2009/0025780 | A1 * | 1/2009 | Nakata | 136/250 |
| 2010/0067224 | A1 | 3/2010 | Wu | |

FOREIGN PATENT DOCUMENTS

| | | | |
|---|---|---|---|
| DE | 100 06 804 | A1 | 8/2001 |
| DE | 100 06 804 | C2 | 8/2001 |
| DE | 10044455 | A1 | 4/2002 |
| DE | 696 19 286 | T2 | 8/2002 |
| DE | 10245933 | A1 | 4/2004 |
| DE | 69434674 | T2 | 1/2007 |
| EP | 1 983 577 | A1 | 10/2008 |
| EP | 2 138 753 | A1 | 12/2009 |
| KR | 100857058 | B1 | 9/2008 |
| SU | 1352549 | | 11/1987 |
| WO | 2008/058446 | A1 | 5/2008 |
| WO | WO-2008/1148132 | A1 | 9/2008 |
| WO | 2008122924 | A1 | 10/2008 |
| WO | WO-2009/000282 | A1 | 12/2008 |
| WO | WO-2009/000369 | A2 | 12/2008 |

OTHER PUBLICATIONS

Translation of The International Preliminary Report on Patentability. International Search Report dated May 18, 2010. PCT/EP10/000488. European Examination Report related to EP 10 701 631.3 dated Aug. 19, 2014.

* cited by examiner

ILLUMINATION UNIT

CROSS-REFERENCE TO RELATED APPLICATIONS

This application is the U.S. National Phase of PCT/EP2010/000488 filed Jan. 27, 2010 which claims priority of German Patent Application 10 2009 006 184.3 filed Jan. 27, 2009.

The invention relates to an illumination unit for illuminating large areas, having a carrier device to which a plurality of light emitting diodes are fastened in a two-dimensional arrangement.

Such an illumination unit typically serves for illuminating outside areas (e.g. streets, parking lots, foot paths, sports grounds) or of inner spaces of buildings (e.g. industrial buildings, multi-story car parks, shopping malls, railroad stations, airports). The use of light emitting diodes allows a reduction in the energy consumption, for example with respect to conventional sodium vapor lamps, mercury vapor lamps, incandescent light bulbs or fluorescent tubes.

It is an object of the invention to provide an illumination unit using light emitting diodes which can be easily adapted to the desired application with a simple structure. A further object of the invention is to provide an illumination unit having light emitting diodes which has a small energy consumption.

This object is satisfied by an illumination unit having the features of claim 1.

The illumination unit has a carrier device to which a plurality of light emitting diodes are fastened in a two-dimensional arrangement to form a so-called array. The light emitting diodes are arranged, for example, in a plurality of rows which extend along a respective longitudinal direction. These rows are arranged adjacent to one another in the transverse direction, that is perpendicular to the named longitudinal direction. The light emitting diodes hereby form a rectangular matrix. Alternatively to this, the light emitting diodes can, for example, be arranged in accordance with a pattern having a round outline, in a plurality of concentric rings, in accordance with a triangle or in accordance with another polygon (e.g. hexagon). In each of the named cases, an areal illumination unit is formed to be able to illuminate large areas. The light emitting diodes can in particular emit light (e.g. with the aid of wavelength-modified substances). Generally, however, any desired emission spectrum is possible, with non-visible emission spectra also being possible (e.g. infrared radiation) and with different colored emission spectra also being able to be combined (e.g. a group of red light emitting diodes, a group of green light emitting diodes and a group of blue light emitting diodes). Light emitting diodes having a high luminous flux ("high brightness") are preferably used.

A plurality of reflector elements are fastened to the carrier device between the light emitting diodes. The reflector elements preferably have a longitudinal shape and form a partition wall between at least two adjacent light emitting diodes. The reflector elements are thus associated with a plurality of light emitting diodes, i.e. each reflector element is effective as a reflector for a plurality of light emitting diodes. The respective reflector element preferably extends laterally to the associated light emitting diodes without surrounding the light emitting diodes circumferentially (e.g. in the manner of a funnel). The reflector elements are formed separately from one another and also separately from the carrier device and separately from the light emitting diodes.

Reflector structures which extend between the light emitting diodes are hereby formed for the areal distribution of the light emitting diodes. The reflector of the illumination unit hereby has a particularly simple and robust design. No separate lenses of the illumination unit are required, i.e. no lenses in addition to any integrated lenses of the light emitting diodes themselves. Furthermore, no filler material is also absolutely necessary in the intermediate space between adjacent reflector elements.

The illumination unit can above all be adapted easily to different applications or customer wishes thanks to choosing between different reflector elements. On the one hand, a suitable angle of inclination of the reflector elements can be selected in dependence on the intended installation height of the illumination unit and in dependence on the intended radiation characteristic of the illumination unit (e.g. angle characteristic in the X/Y direction) for example with reference to a calculation formula or a data sheet. In other words, such reflector elements are fastened to the carrier device whose angle of inclination effects the radiation characteristic suitable for a specific installation height. Alternatively or additionally, for example, the number of the reflector elements per carrier device, the arrangement of the reflector elements at the carrier device, the shape of the reflector elements and/or their length can be selected accordingly. Such an adaptation of the illumination unit, for example for street lighting, is particularly advantageous since street lighting units are not installed at a uniform height.

On the other hand, in dependence on the desired illumination and brightness, a plurality of illumination units of the explained kind can be arranged next to one another in one direction or in two directions perpendicular to one another to increase the area along which the light emitting diodes are arranged and hereby to increase the radiation flow (luminous power). A two-dimensional arrangement of a plurality of illumination units can in particular be provided in the form of a mosaic.

The radiation characteristic can be matched particularly precisely to a desired application by the use of a plurality of separate reflector elements. Since the reflector elements are arranged between the light emitting diodes without a respective reflector element necessarily circumferentially surrounding the light emitting diodes, the fastening of the reflector elements to the carrier device can take place within advantageously large tolerances without this having a noticeable effect on the radiation characteristic. An inexpensive manufacture of the illumination unit is thus possible despite the additional fastening steps (for the plurality of separate reflector elements).

Preferred embodiments are described in the following and in the dependent claims.

In accordance with an advantageous embodiment, the reflector elements are elongate, for example as reflector webs. The respective reflector elements can hereby be effective in a simple manner for a large number of light emitting diodes at the same time, namely for the light emitting diodes arranged at the two longitudinal sides of the respective reflector element.

The reflector elements have a straight-line form to allow a simple arrangement between two straight-line rows of light emitting diodes. Alternatively to this, the reflector elements can have a curved shape (e.g. C-shaped or S-shaped) or an angled shape (e.g. L-shaped or Z-shaped). Furthermore, for example, a meandering shape is also possible, e.g. a swerving shape or a zigzag shape.

In accordance with an embodiment, the reflector elements taper in cross-section (i.e. in a plane perpendicular to the carrier device and perpendicular to the longitudinal direction of extent of the respective reflector elements) as the distance from the carrier plate increases. A desired radiation characteristic of the illumination unit can hereby be defined.

The reflector elements can, for example, be trapezoidal or wedge-shaped in cross-section (i.e. in a plane perpendicular to the carrier device and perpendicular to the longitudinal direction of extent of the respective reflector element). The reflector elements can hereby satisfy a directional function for the two adjacent rows of light emitting diodes.

The reflector elements can have flanks at two longitudinal sides which face adjacent light emitting diodes, said flanks been inclined by the already named angle of inclination with respect to a surface normal of the carrier device. Since reflector elements having different such angles of inclination are kept available and are selectively fastened to the carrier device, a desired radiation characteristic of the illumination unit can be set.

The named flanks of the reflector elements can extend continuously in a straight line or continuously in a concave manner with respect to a longitudinal sectional plane extending parallel to the carrier device and in particular with respect to a longitudinal direction of extent of the respective reflector element. A particularly simple design of the reflector elements hereby results, with a longitudinal matching being possible by a simple cutting to length. It is, alternatively, however, also possible, for example, that the reflector elements are formed in the longitudinal direction with a number of indentations corresponding to the number of the adjacent light emitting diodes. A section of a single reflector is therefore hereby formed for each light emitting diode.

The reflector elements are preferably screwed to the carrier device. It is alternatively possible, for example, that the reflector elements are riveted, adhesively bonded, soldered, welded or fastened by a press fit to the carrier device.

In accordance with an advantageous embodiment, at least some of the light emitting diodes are arranged in a plurality of rows, with the named separate reflector elements being fastened to the carrier device between the rows of light emitting diodes and extend substantially parallel to the named rows of light emitting diodes. The respective reflector element can hereby be effective for the two adjacent rows of light emitting diodes, whereas a simple change in the radiation characteristic is simultaneously possible by replacing the reflector elements.

At least one reflector element is preferably fastened to the carrier device between each pair of adjacent rows of light emitting diodes. This is, however, not absolutely necessary (depending on the desired radiation characteristic). Some intermediate spaces between adjacent light emitting diodes or between adjacent rows of light emitting diodes can in particular also remain free of reflector elements.

As already explained, light emitting diodes having a high brightness are preferably used. To effectively lead away the power loss hereby arising, it is particularly advantageous if the named reflector elements are simultaneously effective as a cooling device in the manner of cooling fins. It is preferred for this purpose if the reflector elements are thermally conductively connected to the light emitting diodes (for example to their rear sides) via the carrier device.

The reflector elements can in particular be made from metal, for example from aluminum (gloss or matt), with optionally a transparent protective layer being able to be provided. The desired thermal conductivity properties are hereby particularly effectively associated with suitable reflection properties. Alternatively, the reflector elements can, however, be made, for example, from a metal-coated plastic, for example from an aluminum-coated plastic. Alternatively or additionally to the use of the reflector elements as a cooling device, a cooling body can be arranged at the side of the carrier device remote from the light emitting diodes or the carrier device itself forms a cooling body.

Particularly favorable reflection properties result when the reflector elements are diffusely reflecting, with the light emitting diodes preferably being arranged outside the focal point of the reflector elements. The reflector elements thus, with a simple structure, only effect a bounding of the radiation angle of the light emitting diodes perpendicular to the direction of extent of the respective reflector element, but no focusing. The illumination unit is thus particularly well-suited for an illumination of large areas with an inhomogeneous angle characteristic in the X/Y direction, as is in particular desired for street lighting. Such a diffusely reflecting design can, for example, be achieved by using matt aluminum as the reflector material.

To achieve the desired thermal conductivity properties, the carrier device preferably has a layer of metal, with the reflector elements being connected to the metal layer directly or via a thermally conductive insulating layer (i.e. a thermally conductive, but electrically insulating layer). The metal layer preferably comprises copper, a copper alloy, aluminum or an aluminum alloy.

The named metal layer is preferably arranged at that side of the carrier device to which the light emitting diodes are fastened, with the named insulating layer being very largely transparent for the radiation emitted by the light emitting diodes in order simultaneously to be active as a supplementary reflector.

The carrier device is, for example, a flexible or rigid circuit board having a flexible or rigid carrier of plastic, metal or ceramic material (e.g. film or metal sheet) and having conductor tracks which are electrically connected to the light emitting diodes to supply the light emitting diodes with electric energy. The aforesaid metal layer can in particular simultaneously form an electric conductive track.

A particularly simple wiring of the light emitting diodes results in this respect if a plurality of the light emitting diodes are connected electrically in series. Alternatively to this, the light emitting diodes can be connected in parallel or the light emitting diodes are controlled individually.

In accordance with a particularly advantageous embodiment, the illumination unit has a light sensor which measures the brightness of the environmental light. An evaluation device is furthermore provided which is made to control the energy supply of the light emitting diodes in dependence on the measured value of the light sensor. The evaluation device can, for example, read out a suitable value of the electric supply current from a look-up table in dependence on the measured value of the light sensor and, for example, on the time or on a control signal supplied form external. A simple desired/actual comparison can also be carried out.

In such an embodiment with a light sensor, the energy requirement can be substantially reduced in that a supply of the light emitting diodes takes place dependent on requirements.

A particularly effective reduction of the energy requirement is achieved if the named light sensor has a spectral sensitivity which is matched to the spectral sensitivity of the human eye. It is namely hereby ensured that the detection of the brightness of the environmental light is modeled on the perception of the human eye and it is avoided that the evaluation device sets too high an energy supply of the light emitting diodes, i.e. an unnecessarily high brightness, due to an unsuitable spectral sensitivity of the light sensor. The spectral sensitivity of the human eye extends from approximately 380 nm to approximately 780 nm, whereas the spectral sensitivity of a typical light sensitive element reaches far into the infrared (e.g. maximum at approximately 900 nm with photoelements on a silicon basis or a maximum at approximately 1500 nm with photoelements on a germanium basis).

The light sensor can for this purpose have a combination of a light sensitive element (e.g. photodiode, phototransistor) with an optical filter (e.g. band pass filter, edge filter).

It is particularly advantageous in this connection if the spectral sensitivity of the light sensor is matched to the spectral sensitivity of the night vision of the human eye (so-called scotopic vision) which is generally at shorter wavelengths than the spectral sensitivity of day vision of the human eye (so-called photopic vision). The spectral sensitivity of the light sensor can in particular extend from approximately 400 nm to approximately 620 nm with a maximum at approximately 510 nm.

It is furthermore of advantage if the light sensor is arranged at an end face of the illumination unit facing away from the radiation angle or rear face of the light emitting diodes. This is typically the upper side of the illumination unit with respect to the position of use of the illumination unit. An unwanted optical feedback with the light transmitted by the illumination light is hereby avoided.

Alternatively or additionally to this, the illumination unit can have a radio receiver and an evaluation device. The radio receiver can, for example, receive a control signal via radio from a higher ranking control unit or from an adjacently installed illumination unit, said control signal being evaluated by the illumination device to control the energy supply of the light emitting diodes in dependence on the received control signal. This control can include a simple switching on and off or a dimming of the light emitting diodes.

In addition to the radio receiver, the illumination unit can have a radio transmitter so that the illumination unit can communicate bidirectionally with a higher ranking control unit or with an adjacently installed illumination unit. For example, a plurality of adjacent illumination units can hereby form a communication chain to be able to detect a large number of illumination units by radio at a low range of the radio signals. The evaluation device is preferably made, on the presence of a radio transmitter, to transmit state data and/or environmental data by means of the radio transmitter. The named state data, for example, include information on the operability of the respective illumination unit, the power consumption of the respective illumination unit, the operability of the light emitting diodes of the respective illumination unit and/or the operability of a different illumination unit (from which a corresponding state signal has previously been received by radio). The named environmental data, for example, include a measured value of a light sensor connected to the evaluation device, a measured value of a temperature sensor connected to the evaluation unit and/or a measured value previously received by radio.

In such an embodiment with a radio receiver, the energy requirement can also be substantially reduced in that a supply of the light emitting diodes takes place dependent on requirements.

The invention also generally relates to an illumination unit having a plurality of light emitting diodes in which a light sensor and an evaluation device or a radio receiver and an evaluation device are provided independently of the arrangement of the light emitting diodes and independently of the presence or of the embodiment of a reflector in order to control the energy supply of the light emitting diodes in the manner explained above.

The invention furthermore also relates to an illumination device having a plurality of illumination units of the explained kind which are arranged next to one another as a modular system in one direction or in two directions perpendicular to one another. The illumination device can hereby easily be matched to a desired radiation flow (luminous power) while using the same carrier devices.

The invention also relates to an illumination unit modular system having at least one illumination unit of the kind explained above, with the modular system including at least one kind of a carrier device (having a predetermined or selectable arrangement of light emitting diodes) and different sets of reflector elements which can selectively be fastened to the carrier device to match the respective illumination unit to a desired use or to set a desired radiation characteristic. The reflector components of the different sets (and thus the reflector elements of different illumination units) differ in such a modular system with respect to at least one of the following features:

- respective angle of inclination with respect to a surface normal of the carrier device;
- shape;
- length;
- number of reflector elements per carrier device; and/or
- arrangement of the reflector elements at the carrier device (e.g. arranging of a reflector unit between each row of light emitting diodes or only between every second row).

By the use of a plurality of separate reflector elements, the radiation characteristic can be set particularly precisely, for example by varying the number of reflector elements per carrier device or by fastening reflector elements having different angles of inclination to a (single) carrier device.

Optionally, such a modular system can also include a plurality of different kinds of carrier devices (e.g. different size).

The invention will be explained in the following only by way of example with reference to the drawings.

Figure 5:
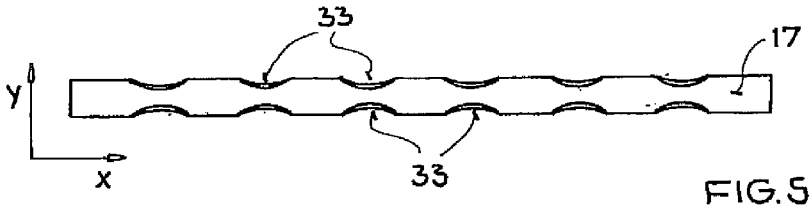

FIGS. 4*a* to 4*d* show a respective cross-section of different reflector elements;

FIG. 5 shows a longitudinal section of a reflector element; and

Figure 6A:
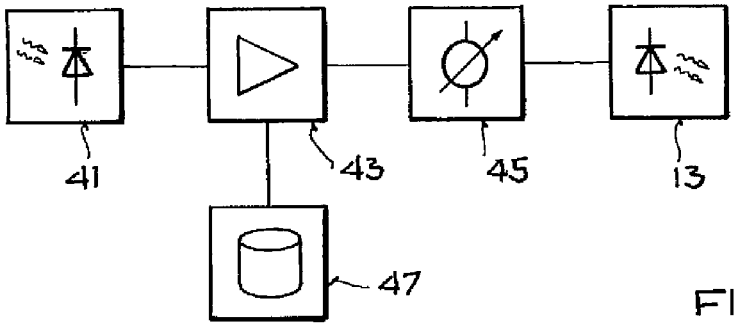
Figure 6B:
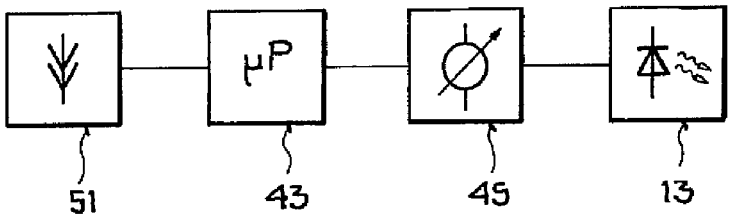

FIGS. 6*a* and 6*b* show circuits for a brightness control.

Figure 1:
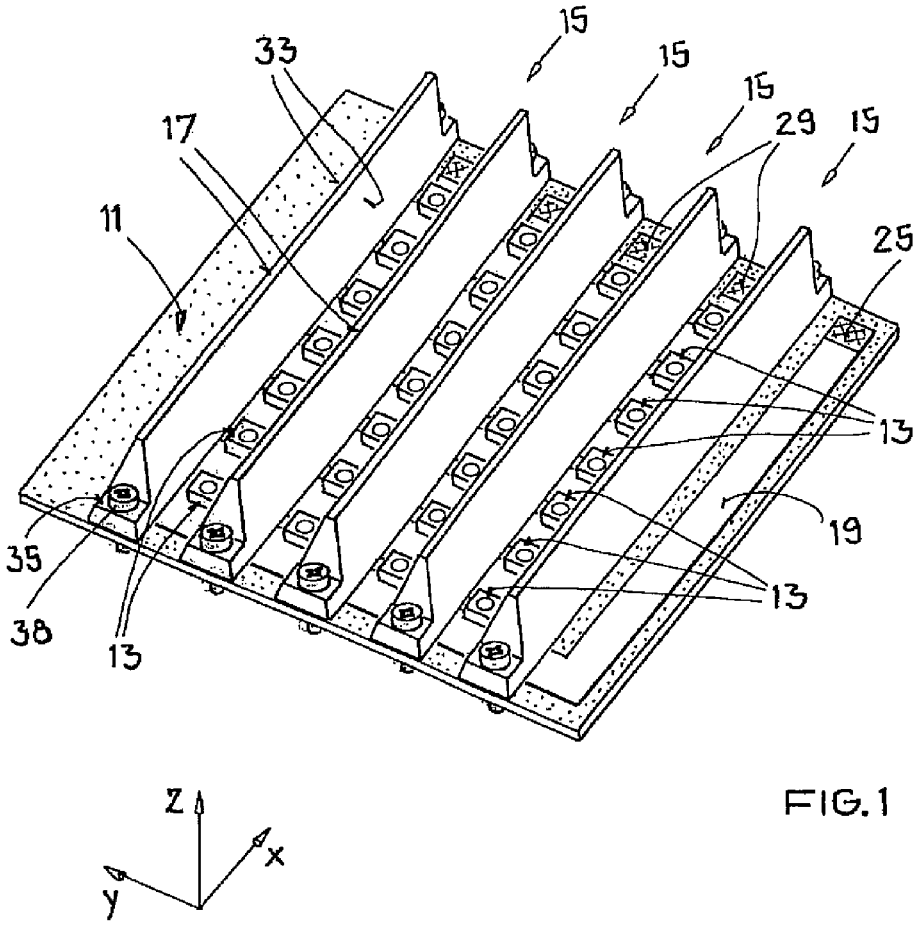
FIG. 1 shows an illumination unit in a perspective view.

FIG. 1 shows an illumination unit having a carrier device 11 to which a plurality of light emitting diodes 13 are fastened (for example, soldered, bonded or conductively adhered). The light emitting diodes 13 are arranged in a plurality of rows 15 which extend parallel to one another along a respective longitudinal direction X and are arranged adjacent to one another with respect to a transverse direction Y so that the light emitting diodes 13 are arranged in accordance with a two-dimensional pattern.

A respective web-shaped reflector element 17 is fastened, namely screwed in the example shown here, to the carrier device 11 between two adjacent rows 15 of light emitting diodes 13. A respective reflector element 17 is also fastened to the carrier device 11 outwardly adjacent to the two outermost rows 15 of light emitting diodes 13 in the transverse direction Y. Each reflector element 17 is thus active as a reflector for a plurality of light emitting diodes 13.

The light emitting diodes 13 typically transmit visible light at a nominal radiation angle of approximately 120° with a substantially white emission spectrum or infrared radiation. The light emitting diodes 13 can, for example, be based on at least on InGaN layer. They are light emitting diodes 13 with high brightness to be able to illuminate large areas.

Figure 2:
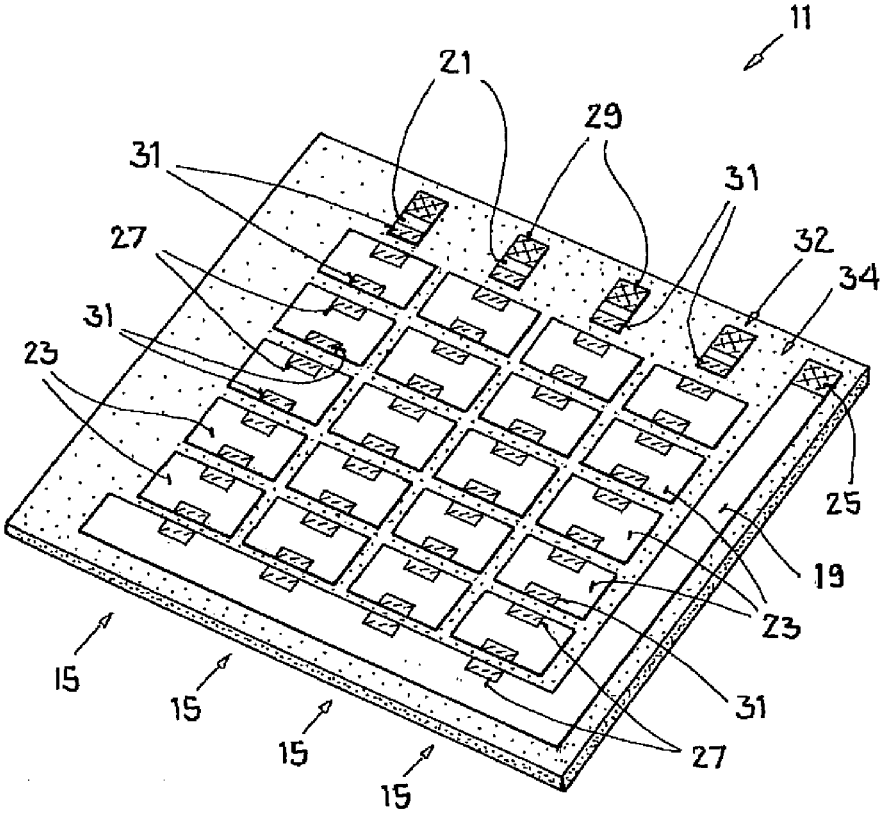
FIG. 2 shows a non-mounted carrier device in a perspective view.

The carrier device 11 in accordance with FIG. 1 is also shown in FIG. 2. The carrier plate 11 is planar. It is a circuit board having a plurality of metallic conductor tracks 19, 21, 23 and a plurality of connection surfaces (i.e. solder surfaces) 25, 27, 29, 31. The conductor track 19 is connected at one end to the connection surface 25 which serves as a positive supply connection. At the other end, the conductor track 19 is connected to the connection surfaces 27 which serve for the contacting of the respective anode of the lower light emitting diodes at the bottom in FIG. 2. The conductor tracks 21 connect the respective connection surface 29 of each row 15 which serves as a negative supply connection to the connection surface 31 which serves for the contacting of the respective cathode of the light emitting diodes at the top in FIG. 2. The conductor tracks 23 connect the respective connection surface 27 (for the anode of the respective light emitting diode) to the respective connection surface 31 (for the cathode of the adjacent light emitting diode of the same row 15). The aforesaid polarities can also be swapped.

It can be seen from FIG. 2 that the light emitting diodes of a row 15 are connected electrically in series (between the connection surface 25 or the conductor track 19, on the one hand, and the respective connection surface 29 or the respective conductor track 21, on the other hand).

The conductor tracks 19, 21, 23 and the connection surfaces 25, 27, 29, 31 form a regionally interrupted metal layer 32 of the carrier device 11 which is arranged at the upper side of the carrier device 11 shown in FIG. 2. This metal layer 32 has reflecting properties with respect to the emission spectrum of the light emitting diodes 13 and is for the greater part (namely with the exception of the connection surfaces 25, 27, 29, 31) covered by an insulating layer 34 which should be as transparent as possible with respect to the emission spectrum of the light emitting diodes 13. The insulating layer 34 effects an electric insulation. It, however, enables a thermal coupling of the reflector elements 17 over the metal layer 32 with the light emitting diodes 13 so that not only the metal layer 32 forms a heat sink, but also the reflector elements 17 (exposed at the upper side of the carrier device 11) are effective as a cooling device for the light emitting diodes 13. For this purpose, the reflector elements 17 overlap with the lateral regions of the conductor tracks 23. The reflector elements 17 thus serve as (front) cooling fins to be able better to lead off the loss heat of the high brightness light emitting diodes 13.

Figure 3:
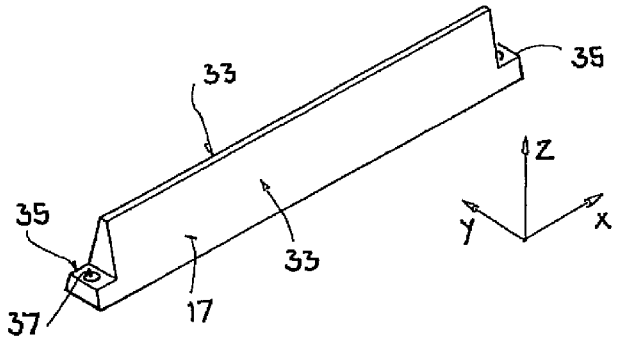
FIG. 3 shows a reflector element in a perspective view.

The reflector elements 17 comprise solid metal in the example shown here. The explained cooling function can hereby be satisfied particularly well. One of the reflector elements 17 in accordance with FIG. 1 is shown in FIG. 3. The reflector elements 17 have a longitudinal form and are made in one piece over their length. The reflector elements 17 have a trapezoidal cross-section, with the reflector elements 17 tapering as the distance from the carrier device 11 increases, i.e. along a surface normal Z of the carrier device 11. Each reflector element 17 has a respective flank 33 along its two longitudinal sides which forms the actual reflector surface. Each reflector element 17 has a fastening section 35 with a bore 37 at the two longitudinal ends. Each reflector element 17 is fastened to the carrier device 11 via the two fastening sections 35, namely by means of screws 38 which are guided through the respective bore 37 (cf. FIG. 1).

Figures 4A, 4B, 4C, 4D:
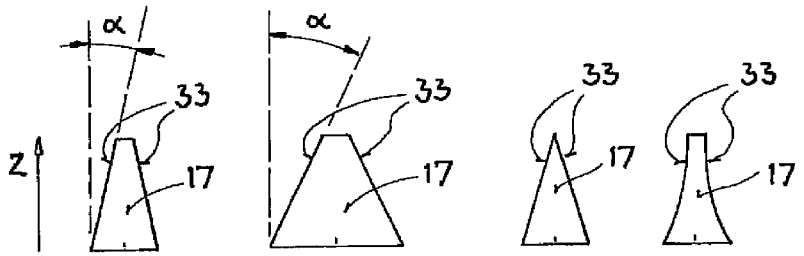

FIG. 4*a* shows a cross-section of a reflector element 17 in accordance with FIGS. 1 and 3 along a YZ plane. It can be seen from FIG. 4*a* that the flanks 33 are inclined by an angle of inclination $\alpha$ with respect to the surface normal Z of the carrier device 11. This angle of inclination $\alpha$ can amount, for example, to 10°, 20°, 30°, 40° or 50°. FIG. 4*b* shows an embodiment with a larger angle of inclination $\alpha$. Sets of reflector elements 17 having different angles of inclination $\alpha$ of the flanks 33 can in particular be provided with which a respective carrier device 11 is selectively mounted to achieve a desired predetermined radiation characteristic of the respective illumination unit.

FIG. 4*c* shows a similar embodiment to FIG. 4*a*, with the cross-section of the reflector element 17 being wedge-shaped, i.e. triangular, here.

In the embodiments in accordance with FIGS. 4*a* to 4*c*, the flanks 33 are straight-lined in cross-section. Alternatively to this, the flanks 33 can be concavely curved in cross-section to achieve a modified radiation characteristic. This is shown in FIG. 4*d*.

In the embodiment of the reflector elements 17 in accordance with FIGS. 1 and 3, the flanks 33 are continuously planar in the longitudinal direction X. Alternatively to this, the flanks can be continuously concavely curved in the longitudinal direction X in accordance with the cross-section in accordance with FIG. 4*d*.

A particularly good luminance results when the height of the reflector elements 17 (extent in the Z direction) is larger than their width (extent in the Y direction) as is the case in the embodiments in accordance with FIGS. 4*a*, 4*c* and 4*d*.

In accordance with a further alternative, a plurality of indentations 39 are formed at the flanks 33 of the reflector elements 17, with each indentation 30 being associated with an adjacent light emitting diode 13 to form a reflector section for it. The indentations 39 are therefore regularly distributed in the longitudinal direction X. FIG. 5 shows a longitudinal section of such a reflector element 17, with the sectional plane corresponding to an XY plane, i.e. being offset parallel to the plane of extent of the carrier device 11. The indentations 39 extend in this respect in the direction of observation, i.e. along the Z direction.

The illumination unit described in connection with FIGS. 1 to 5 serves as outside lighting (e.g. street lighting) or for illuminating large areas of an inner space of a building. This illumination unit is characterized by a simple and rugged design since essentially only the reflector elements 17 are required as optical elements. Since the reflector elements 17 are formed separately from the carrier device 11, the illumination unit has a modular structure. It is hereby possible selectively to mount a respective illumination unit with one of a plurality of different sets of reflector elements 17 which differ, for example, with respect to the angles of inclination $\alpha$ of the flanks 33 of the reflector elements 17. An illumination device particularly suitable for a specific application can hereby be configured in a simple manner.

It can, for example, be determined with reference to a look-up table, once one has been prepared, which angle of inclination $\alpha$ is best suited for a specific fastening height of the illumination unit, with the result being that the respective set of reflector elements 17 is fastened to the carrier device 11. It can also be determined in a corresponding manner whether a plurality of the explained illumination units have to be arranged in the longitudinal direction (X direction) and/or in the transverse direction (Y direction). A modular system is therefore hereby provided which allows a user himself to configure a suitable configuration of an illumination device (which likewise comprises a plurality of illumination units of the kind shown) with reference to simple tables.

It is further of particular advantage that no further optical elements such as lenses are absolutely necessary. Nor is it necessary to provide an additional filler material in the intermediate space between adjacent reflector elements 17. A simple transparent cover as protection against contamination is sufficient.

Whereas a rectangular arrangement of four rows 15 each having six light emitting diodes 13 is shown for the embodiment in accordance with FIGS. 1 to 5, other two-dimensional arrangements of light emitting diodes are naturally also possible. At least two rows 15 of light emitting diodes 13 are preferably provided, with each row 15 including at least three light emitting diodes 15. It is, however, also possible within the framework of the invention, to arrange the light emitting diodes, for example, in accordance with a pattern having a round outline or in a plurality of concentric rings, with the shape of the reflector elements generally being matched to the extent of the intermediate spaces between adjacent light emitting diodes.

It is also possible within the framework of the invention that a plurality of rows 15, in particular two rows, of light emitting diodes extend between two reflector elements 17. In the embodiment in accordance with FIGS. 1 to 5, for example, the middle reflector element 17, or the second and the fourth reflector elements 17, can also be omitted. In order only slightly to modify the radiation characteristic with respect to the embodiment in accordance with FIGS. 1 to 5, reflector elements 17 having a plurality of different angles of inclination $\alpha$ can also be fastened to the carrier device 11.

Two particularly advantageous further developments of an illumination unit having a plurality of light emitting diodes will be explained in the following with reference to FIGS. 6*a* and 6*b*. The advantages described in this connection are not restricted to an illumination unit which has a plurality of reflector elements 17 in accordance with FIGS. 1 to 5. A control of the performance of the light emitting diodes and thus a control of the brightness of the illumination unit takes place in the two cases described in the following.

FIG. 6*a* shows a control circuit having a light sensor 41, for example a phototransistor or a photodiode (if necessary with an amplifier). The light sensor 41 is designed and arranged at the illumination unit so that the light sensor 41 allows a measurement of the environmental light. The light sensor 41 can, for example, be arranged at an end face which faces away from the radiation angle of the light emitting diodes or at a rear side of the illumination unit or carrier device for the light emitting diodes of the illumination unit. The output of the light sensor 41 is connected to an evaluation unit 43 which evaluates a measured value of the light sensor 41 to control an energy supply device 45 which supplies the light emitting diodes 13 of the respective illumination unit with electric energy. The energy supply device 45 can, for example, be a controllable power source.

The evaluation unit 43 can, in accordance with a simple embodiment, have a comparator which compares the measured value of the light sensor 41 with a stored or otherwise preset desired value to control the energy supply device 45 in dependence on the desired/actual comparison. It is hereby achieved that the illumination unit produces a reduced luminous power with sufficient environmental light. A reduced energy consumption is thus made possible.

Alternatively to the embodiment of the evaluation device 43 with a simple comparator, the evaluation unit 43 can be connected to a memory device 47 in which a look-up table is stored. In this case, the evaluation device 43 can read out a suitable value from the memory device 47 in dependence on the measured value of the light sensor 41 and in dependence on further parameters (such as the time or the day of the week) which is transferred to the energy supply device 45 as a control signal. Alternatively to a look-up table, a predetermined calculation rule can also be stored.

FIG. 6*b* shows a similar control circuit for an illumination unit having light emitting diodes. This embodiment includes a radio receiver 51 which is designed to receive a control signal transmitted via radio. This control signal can be transmitted from a central control unit for a plurality of illumination units. The received signal of the radio receiver 51 is transmitted to an evaluation device 43 which, for example, includes a microprocessor. The evaluation device 43 controls an energy supply device 45 for the light emitting diodes 13 of the illumination unit in dependence on the received signal of the radio receiver 51. A brightness control of the illumination unit as required is hereby made possible in a simple manner to reduce the energy consumption.

The evaluation device 43 in accordance with FIG. 6*b* can take account of further parameters or input signals in addition to the received signal of the radio receiver 51. A combination of the embodiments in accordance with FIG. 6*a* and FIG. 6*b* is also possible. The evaluation device 43 can therefore take account of the measured value of a light sensor 41 and additionally of the received signal of a radio receiver 51 in order to control an energy supply device 45 of the illumination unit on the basis of a predetermined computing rule or a look-up table.

In addition, it is possible that with the control circuit in accordance with FIG. 6*b* the radio receiver 51 is simultaneously made as a radio transmitter to form a transmitter/receiver device (a so-called transceiver). In this case, the evaluation unit 43 is designed to control the radio transmitter/radio receiver 51 to transmit state data and/or environmental data (for example, information on the operability of the light emitting diodes 13 or the measured value of a connected light sensor 41 in accordance with FIG. 6*a*).

REFERENCE NUMERAL LIST

11 carrier device
13 light emitting diode
15 row
17 reflector element
19 conductor track
21 conductor track
23 conductor track
25 connection surface
27 connection surface
29 connection surface
31 connection surface
32 metal layer
33 flank
34 insulating layer
35 fastening section
37 bore
38 screw
39 indentation
41 light sensor
43 evaluation device
45 energy supply device
47 memory device
51 radio receiver
$\alpha$ angle of inclination
X longitudinal direction
Y transverse direction
Z surface normal of the carrier device

The invention claimed is:

1. An illumination unit for illuminating large areas, having a carrier device (1) to which a plurality of light emitting diodes (13) are fastened in a two-dimensional arrangement, wherein a plurality of separate reflector elements (17) are fastened to the carrier device (11) between the light emitting diodes (13), wherein the reflector elements (17) are formed from metal or from a metal-coated plastic, and wherein the reflector elements (17) are thermally conductively connected to the light emitting diodes (13) via the carrier device (11) so that the reflector elements (17) are active as a cooling device for the light emitting diodes (13).

2. An illumination unit in accordance with claim 1, wherein each reflection unit (17) is associated with a plurality of light emitting diodes (13).

3. An illumination unit in accordance with claim 1, wherein the reflector units (17) are elongate and are in particular made as reflector webs.

4. An illumination unit in accordance with claim 1, wherein the reflector elements (17) have a straight-line shape, a curved shape, an angled shape or a meandering shape.

5. An illumination unit in accordance with claim 1, wherein the reflector elements (17) taper as the distance from the carrier device (11) increases with respect to a cross-sectional plane extending perpendicular to the carrier device (11).

6. An illumination unit in accordance with claim 1, wherein the reflector elements (17) are trapezoidal or wedge-shaped with respect to a cross-sectional plane extending perpendicular to the carrier device (11).

7. An illumination unit in accordance with claim 1, wherein the reflector elements (17) have flanks (33) which are inclined with respect to a surface normal (2) of the carrier device (11).

8. An illumination unit in accordance with claim 7, wherein the flanks (3) are straight-lined or are concavely curved with respect to a cross-sectional plane extending perpendicular to the carrier device (11).

9. An illumination unit in accordance with claim 7, wherein the flanks (33) are formed as continuously planar, continuously concave or with a plurality of indentations (39) with respect to a longitudinal sectional plane extending parallel to the carrier device (11).

10. An illumination unit in accordance with claim 1, wherein the height of the reflector elements (17) is larger than the width.

11. An illumination unit in accordance with claim 1, wherein the reflector elements (17) are screwed, riveted, adhesively bonded, soldered, welded, latched or fastened by press fit to the carrier device (11).

12. An illumination unit in accordance with claim 1, wherein at least some of the light emitting diodes (13) are arranged in a plurality of rows (15), with the reflector elements (17) being fastened to the carrier device (11) between the rows (15) of light emitting diodes (13).

13. An illumination unit in accordance with claim 12, wherein at least one reflector element (17) is fastened to the carrier device (11) between each pair of adjacent rows (15) of light emitting diodes (13).

14. An illumination unit in accordance with claim 12, wherein the rows (15) of light emitting diodes (13) extend along a longitudinal direction (X) and are arranged adjacent to one another along a transverse direction (Y) so that the light emitting diodes (13) form a two-dimensional matrix, with the reflector elements (17) likewise extending along the longitudinal direction (X).

15. An illumination unit in accordance with claim 14, wherein a respective reflector element (17) is also fastened to the carrier device (11) adjacent to the two outermost rows (15) of light emitting diodes (13) in the transverse direction (Y).

16. An illumination unit in accordance with claim 12, wherein at least two rows (15) of light emitting diodes (13) are provided, with each row having at least three light emitting diodes (13).

17. An illumination unit in accordance with claim 1, wherein the reflector elements (17) are formed from matt aluminum.

18. An illumination unit in accordance with claim 1, wherein the reflector elements (17) are diffusely reflective, and/or wherein the light emitting diodes (13) are arranged outside the focal point of the reflector elements (17).

19. An illumination unit in accordance with claim 1, wherein the carrier device (11) has at least one layer (32) of metal, with the reflector elements (17) being connected to the metal layer (32) directly or via a thermally conductive insulating layer (34).

20. An illumination unit in accordance with claim 19, wherein the metal layer (32) is provided at that side of the carrier device (11) to which the light emitting diodes are fastened, with the insulating layer (34) being transparent.

21. An illumination unit in accordance with claim 1, wherein the carrier device (11) is planar.

22. An illumination unit in accordance with claim 1, wherein the carrier device (11) has conductor tracks (19, 21, 23) to which the light emitting diodes (13) are electrically connected.

23. An illumination unit in accordance with claim 1, wherein a plurality or all of the light emitting diodes (13) are connected electrically in series or in parallel, or wherein the light emitting diodes (13) are controlled individually.

24. An illumination unit in accordance with claim 1, wherein the illumination unit has a light sensor (41) for measuring the environmental light and an evaluation device (43) which is made to control an energy supply (45) of the light emitting diodes (13) in dependence on a measured value of the light sensor.

25. An illumination unit in accordance with claim 24, wherein the light sensor (41) has a spectral sensitivity which is matched to the spectral sensitivity of the human eye.

26. An illumination unit in accordance with claim 25, wherein the light sensor (41) has a combination of a light-sensitive element having an optical filter, and/or wherein the spectral sensitivity of the light sensor (41) ranges from approximately 400 nm to approximately 620 nm with a maximum at approximately 510 nm.

27. An illumination unit in accordance with claim 24, wherein the light sensor (41) is arranged at an end face or a rear side of the illumination unit.

28. An illumination unit in accordance with claim 1, wherein the illumination unit has a radio receiver (51) and an evaluation device (43) which is made to control an energy supply (45) of the light emitting diodes (13) in dependence on a received value of the radio receiver.

29. An illumination unit in accordance with claim 28, wherein the illumination unit further has a radio transmitter, with the evaluation device (43) being made to control the radio transmitter for transmitting state data and/or environmental data.

30. An illumination unit in accordance with claim 1, wherein the light emitting diodes (13) has a white emission spectrum, an infrared emission spectrum or different-colored emission spectra.

31. An illumination unit in accordance with claim 1, wherein the illumination unit is formed without separate lenses and/or without filler material in the intermediate space between adjacent reflector elements (17).

32. An illumination device having a plurality of illumination units for illuminating large areas, wherein the illumination units each have a carrier device (1) to which a plurality of light emitting diodes (13) are fastened in a two-dimensional arrangement, wherein a plurality of separate reflector elements (17) are fastened to the carrier device (11) between the light emitting diodes (13), wherein the illumination units are arranged next to one another in one direction or in two directions (X, Y) perpendicular to one another, wherein the reflector elements (17) are formed from metal or from a metal-coated plastic, and wherein the reflector elements (17) are thermally conductively connected to the light emitting diodes (13) via the carrier device (11) so that the reflector elements (17) are active as a cooling device for the light emitting diodes (13).

33. An illumination unit modular system having at least one illumination unit for illuminating large areas, having a carrier device (1) to which a plurality of light emitting diodes (13) are fastened in a two-dimensional arrangement, wherein a plurality of separate reflector elements (17) are fastened to the carrier device (11) between the light emitting diodes (13), wherein the modular system includes at least one kind of a carrier device (11) and different sets of reflector elements (17) which can be selectively fastened to the carrier device (11), with the reflector elements (17) of the different sets differing from one another with respect to:

a respective angle of inclination ($\alpha$) with respect to a surface nom al (Z) of the carrier device (11);

the shape;

the length;

the number of reflector elements (17) per carrier device (11); and/or the arrangement of the reflector elements (17) at the carrier unit (11), wherein the reflector elements (17) are formed from metal or from a metal-coated plastic, and wherein the reflector elements (17) are thermally conductively connected to the light emitting diodes (13) via the carrier device (11) so that the reflector elements (17) are active as a cooling device for the light emitting diodes (13).

* * * * *